United States Patent [19]

Schwartz

[11] 4,159,729

[45] Jul. 3, 1979

[54] HANDBAG WITH ADJUSTABLE HANDLE AND STRAP

[75] Inventor: Lawrence B. Schwartz, Fairfield, Conn.

[73] Assignee: Acricite Company, Inc., Bridgeport, Conn.

[21] Appl. No.: 928,903

[22] Filed: Jul. 28, 1978

[51] Int. Cl.[2] ..... A45C 13/26

[52] U.S. Cl. ..... 150/33; 224/47

[58] Field of Search ..... 150/12, 33, 30, 28 A; 224/47, 46 R, 43, 44, 45 P

[56] References Cited

U.S. PATENT DOCUMENTS

| | | | |
|---|---|---|---|
| 2,493,182 | 1/1950 | Beder | 150/33 X |
| 2,813,602 | 11/1957 | MacArthur | 150/12 UX |
| 2,979,098 | 4/1961 | Greaves | 150/30 X |
| 3,108,627 | 10/1963 | Tatelman | 150/28 A |

*Primary Examiner*—Donald F. Norton

*Attorney, Agent, or Firm*—Garold E. Bramblett, Jr.

[57] ABSTRACT

A handbag having two connected receptacle portions which can be folded such that their rear surfaces are adjacent to and in alignment with each other and means for detachably affixing these surfaces to each other. The handbag includes a selectively removable handle associated with a connecting piece between the two receptacles and a selectively removable carrying strap. The handbag can be used without a strap or handle, with only a strap, with only a handle, or with both a strap and handle.

11 Claims, 8 Drawing Figures

Fig. 1.
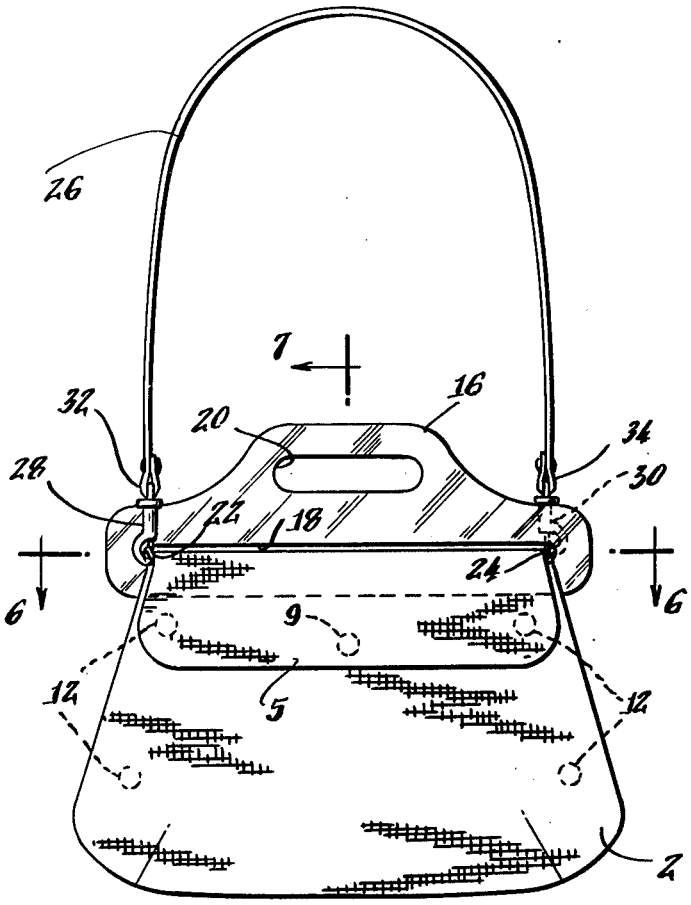
Fig. 2.
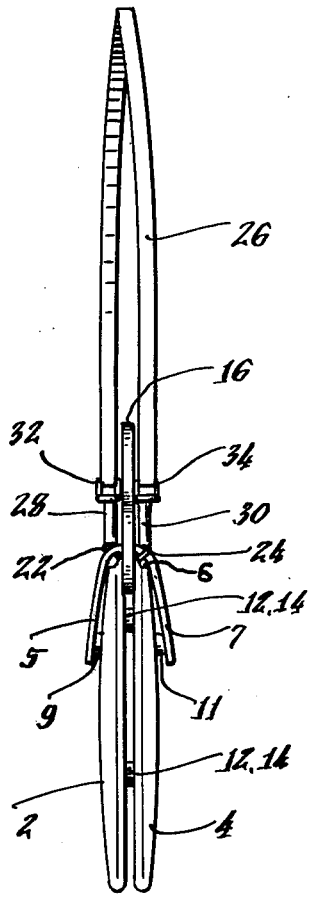
Fig. 3.
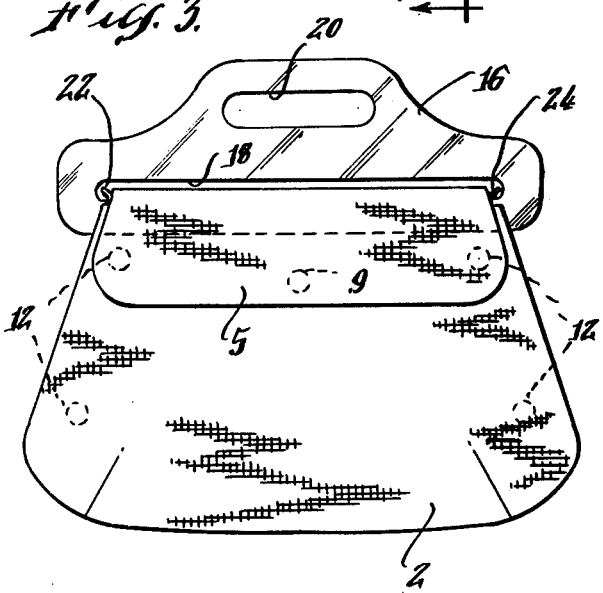
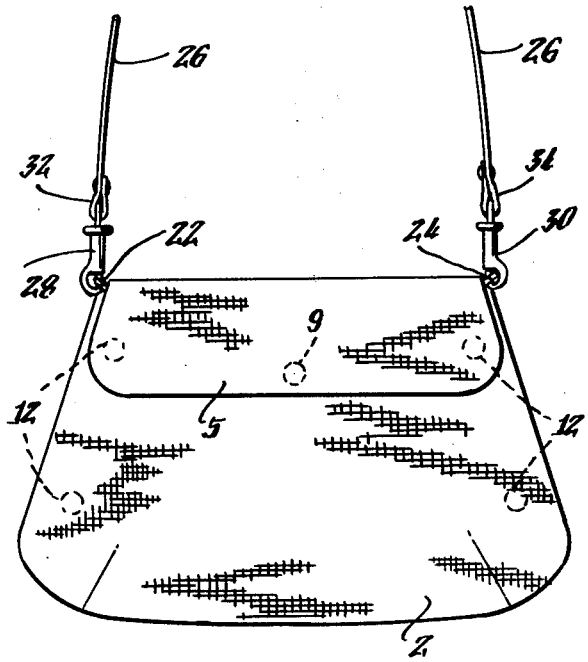
Fig. 4.

HANDBAG WITH ADJUSTABLE HANDLE AND STRAP

BACKGROUND OF THE INVENTION

This invention pertains to handbags, and more particularly to ladies' handbags having a removable strap and a removable handle. Although convertible handbags are known to the art, they are of the type in which either the handle or the straps, but not both, are removable. These handbags allow the user to interchange either straps or handles, respectively, but do not give the owner the choice of selecting between using either a strap, a handle, a strap and a handle, or neither.

Additionally, the known prior art bags with removable handles require separate means, such as hooks or straps, used only for the purpose of affixing the handle to the bag. This increases the cost of manufacture of such bags and requires more effort on the part of the user to remove or interchange the handle.

It is, accordingly, the primary object of this invention to provide a handbag of simple construction with which the user can choose between any of the above-mentioned four handle-strap combinations, thus effectively providing the user with four fashionably distinctive handbags derived from a single basic unit.

It is a further object of this invention to provide a handbag with a removable handle which does not require any additional means for connecting the handle to the bag.

SUMMARY OF THE INVENTION

A handbag includes two receptacle portions which are joined together. A handle defining a slot is provided. Either of the two receptacle portions are threaded through the slot until the slot of the handle engages with means for connecting the receptacles positioned between the receptacles. The two receptacles are folded over so that their rear surfaces are substantially aligned and adjacent to each other. Means for detachably affixing the rear surfaces to each other are provided. A strap and means for detachably affixing the ends of the strap to the handbag are also provided.

BRIEF DESCRIPTION OF THE DRAWINGS

FIG. 1 is a front elevational view of a handbag constructed in accordance with the invention in which both a strap and a handle are affixed.

FIG. 2 is a side elevational view of the handbag of FIG. 1.

FIG. 3 is a front elevational view of the handbag of FIG. 1 with the carrying strap detached.

FIG. 4 is a front elevational view of the handbag of FIG. 1 with the handle detached.

DESCRIPTION OF THE PREFERRED EMBODIMENT

With particular reference to FIGS. 1–8, there is illustrated a handbag in accordance with this invention comprising receptacle portions 2 and 4 formed from a suitable material such as fabric. Flaps 5 and 7 can be used to cover the tops of the receptacles. Means for connecting the two receptacle portions are indicated by the numeral 6. Means for connecting the receptacles can be a piece of fabric formed of the same material as the receptacles and can be joined to the receptacles by any suitable method, such as by sewing. Alternatively, means for connecting the receptacles include a piece of fabric (or other suitable material) which is integrally joined to the receptacles.

Figure 7:
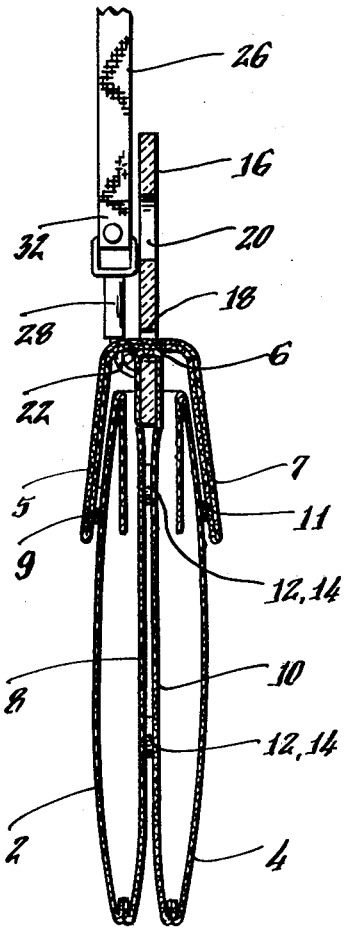
FIG. 7 is a sectional view of the handbag of the present invention taken along line 7—7 of FIG. 1.

The rear surfaces 8 and 10 of the receptacles have male and female snaps 12 and 14, respectively mounted thereon. The material from which the connecting piece joining the receptacles is formed is flexible so that the rear surfaces of the receptacles can be folded over into position adjacent to each other. The snaps are mounted on the rear surfaces in such position that the male and female portions of these snaps are aligned when the receptacle portions are folded. FIGS. 2 and 7 show the handbag in a closed position with the connecting piece forming a bridge between the two receptacles.

FIGS. 1 and 3 show a handle 16 defining a slot 18 and an opening 20. The handle can be formed of any suitable material, for example plastic, and can be of any desired shape. In the preferred embodiment, the slot has a width slightly larger than the thickness of either of the receptacle portions and a length which is approximately equal to the width of the connecting piece so that either of the receptacles can be threaded through the slot until the slot engages the connecting piece. The opening 20 is provided so that the handle can be grasped by the hand of the user.

Figure 5:
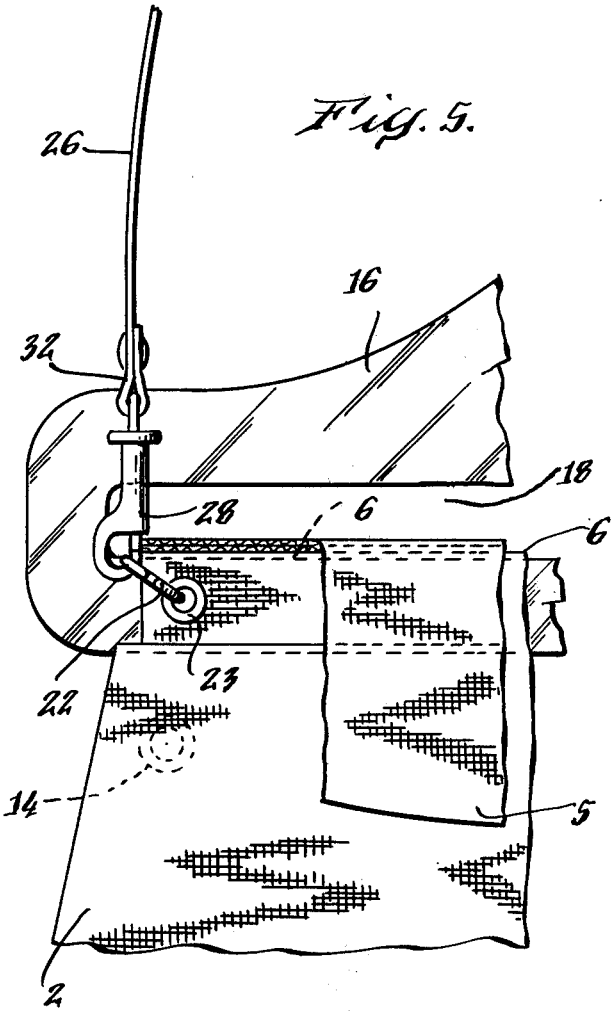
FIG. 5 is a portion of the handbag of FIG. 1 illustrating the connection of the strap to the handbag.

Loops 22 and 24 are affixed to the connecting piece proximate to the outer ends thereof. The connecting piece defines holes 23 and 25 which receive the loops 22 and 24, respectively. A strap 26 has hooks 28 and 30 affixed, respectively, to strap ends 32 and 34. Hook 28 engages loop 22 and hook 30 engages loop 24 so that the handbag can be lifted and carried by the strap, as illustrated in FIGS. 1 and 4. FIG. 5 shows a detailed view of hook 28 in engagement with loop 22. In the preferred embodiment, the hooks are adjustable and remain closed when in engagement with the loops but can be selectively opened when it is desired to remove them from the loops. This can be readily accomplished by, for example, providing the hooks with a spring-loaded closure member biased in the closed position.

Figure 6:
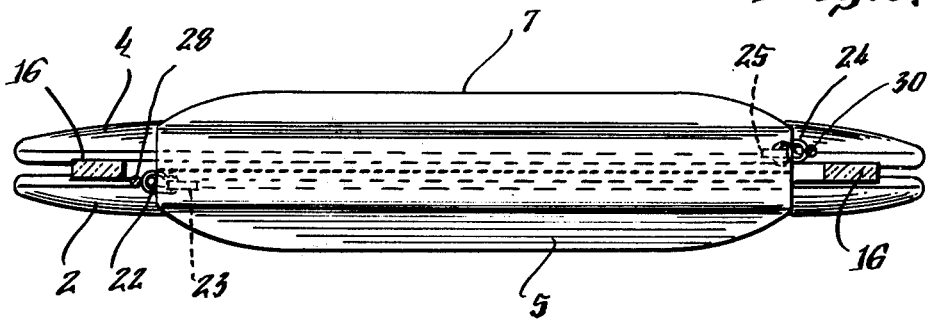
FIG. 6 is a sectional view of the handbag taken alone line 6—6 of FIG. 1.

FIG. 6 shows that loops 22 and 24 are positioned on the connecting piece on opposite sides of the handle when the handle is being used with the bag.

Figure 8:
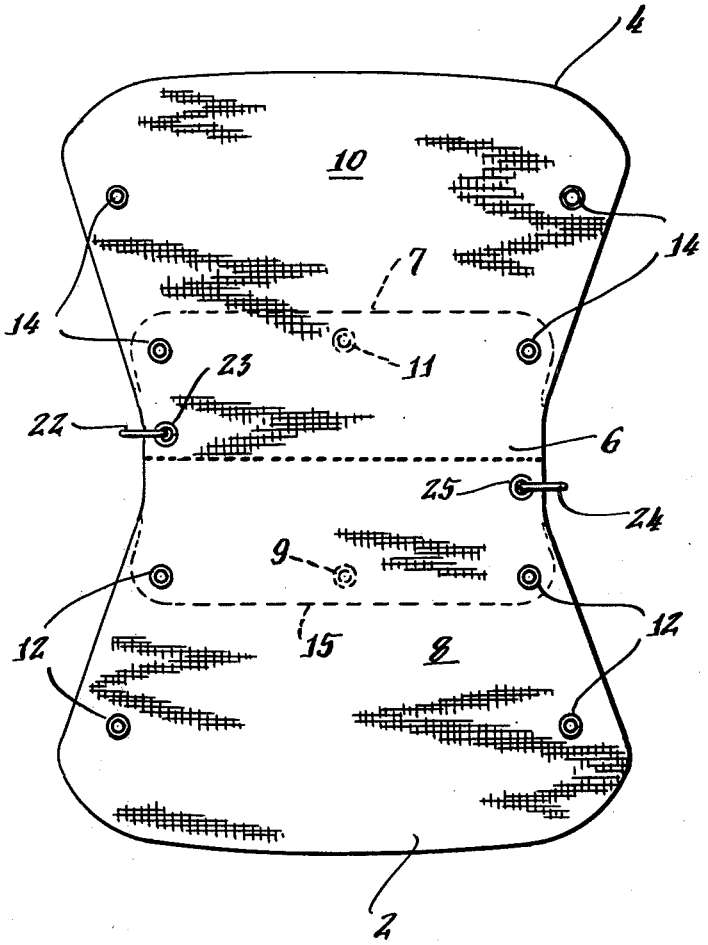
FIG. 8 is a plan view of the handbag constructed in accordance with this invention illustrating the rear surfaces of the receptacle in an unsnapped open position without a handle or carrying strap attached.

The various ways in which the handbag can be used will now be described. The bag is held flat as shown in FIG. 8. The slot 18 of handle 16 engages with the outer end of either receptacle portion and is slid inwardly towards the connecting piece until it is positioned thereon. The width of the connecting piece is approximately the same dimension as the length of the slot so that the connecting piece is flat (and not pinched or ruffled) in the slot. The width of the receptacle portions can be greater than the length of the slot because the receptacles can be made of a flexible material and thus, can be pinched to allow threading of one of the receptacles through the slot.

Once the handle is in engagement with the connecting piece, the receptacle portions can be folded over so that their respective rear surfaces are adjacent to each other and the male and female portions of the snaps carried on the rear surfaces are in alignment with each other. When the snaps are closed, the bag can be lifted by the handle with the receptacle portions depending downardly therefrom, as illustrated by FIG. 3. The handle can be removed from the bag by reversing the procedure.

When the bag is used in this manner, the loops 22 and 24, located on opposite sides of the handle (See FIG. 6), tend to prevent the handle from sliding off of the connecting piece. This maintains the handle in a substantially upright position even when the bag is not being held by the user. The handbag advantageously eliminates the need for separate means for connecting the handle to the bag since the bag itself is slid through the slot on the handle and held in engagement therewith.

The bag can also be carried by the strap 26 by connecting the hooks 28 and 30 to the loops 22 and 24, respectively. The strap is used either in addition to the handle or in lieu of it (See FIG. 4). When the strap is used together with the handle, the handle is maintained in an upright position by the loops 22 and 24, as was explained above and as is illustrated by FIG. 5.

When the bag is used with both the strap and the handle, as illustrated by FIG. 1, the handle becomes primarily decorative in purpose because the strap assumes the supporting and carrying function. The handle may be pleasingly shaped or colored to accomplish its now aesthetic function. Additionally, the handle can serve as an inscription plate upon which the user's name may be inscribed.

In addition to using the bag with a strap and a handle or only a strap or only a handle, it is possible to use the bag as a clutch, that is, with neither a strap or a handle. The bag is readily convertible into this mode by simply removing both the handle and the strap, as described above.

It is obvious from the foregoing description that the invention provides an owner with virtually four distinct styles of handbags all derived from a single basic unit. Additionally, numerous other styles are possible because the handbag is readily adaptable to interchanging different types of handles and different types of straps.

It is believed that the many advantages of this invention will now be apparent to those skilled in the art. It will also be apparent that a number of variations and modifications may be made in this invention without departing from its scope and spirit. Accordingly, the foregoing description is to be construed as illustrative only, rather than limiting. This invention is limited by only the scope of the following claims and all equivalents thereto.

I claim:

1. An adjustable handbag including:

a first and second receptacle and means positioned between said receptacles for joining said receptacles together;

said first and second receptacles each having front and rear surfaces, said means for joining said receptacles being formed of a flexible material such that said first and second receptacles can be folded relative to each other so that said respective rear surfaces are adjacent to each other, means on said rear surfaces for selectively detachably affixing said rear surfaces to each other, a handle defining a slot, said slot being of sufficient dimension to receive either said first or second receptacle, said handle being slideable along either of said receptacles until said slot engages with said means for joining said first and second receptacles, said first and second receptacles depending from said handle when said rear surfaces of said receptacles are affixed to each other and said handle is in engagement with said means for joining said receptacles, whereby said handle is selectively attachable to and removable from said handbag by sliding said handle along said receptacles.

2. A handbag as claimed in claim 1 further including:

a carrying strap, means for removably connecting said carrying strap to said handbag.

3. A handbag as claimed in claim 1 wherein said means for joining said first and second receptacles includes a strip of flexible material positioned between said first and second receptacles and attached thereto by sewing.

4. A handbag as claimed in claim 1 wherein said first and second receptacles are integrally joined to each other.

5. A handbag as claimed in claim 1 wherein said slot defined by said handle has a width of approximately the same dimension as the width of said means for joining said receptacles, wherein said means for joining said receptacles lies flat and non-pinched within said slot when said slot is in engagement therewith.

6. A handbag as claimed in claim 1 wherein said first and second receptacles are of width greater than said slot and said receptacles are formed of a flexible material, wherein said receptacles can be pinched to permit said slot and said handle to slide along said pinched receptacles and into engagement with said means for joining said receptacles.

7. A handbag as claimed in claim 2 wherein said means for removably connecting said strap to said handbag includes at least two loops mounted on said handbag and two corresponding hooks on the ends of said strap, whereby said hooks of said strap are selectively connectible to said loops on said handbag.

8. A handbag as claimed in clain 7 wherein said loops are positioned to opposite sides and proximate to said handle, said loops being so positioned to prevent said handle from sliding along said means for joining said receptacles when said handle is in engagement with said means for joining said receptacles.

9. A handbag as claimed in claim 2 wherein said handle is an inscription plate.

10. A handbag as claimed in claim 1 wherein said means for selectively detachably affixing said rear surfaces to each other include at least one snap carried on said rear surfaces.

11. A handbag as claimed in claim 10 wherein one of said rear surfaces carries at least one female portion of said snap and the other of said rear surfaces carries at least one corresponding male portion of said snap, said male and female portions of said snap being positioned on said respective rear surfaces so that they are in alignment with each other when said first and second receptacle portions are folded such that their respective rear surfaces are adjacent to each other, whereby said rear surfaces are detachably affixed to each other by said snap.

* * * * *